US007048617B1

(12) United States Patent
Spiva

(10) Patent No.: US 7,048,617 B1
(45) Date of Patent: May 23, 2006

(54) METHOD AND APPARATUS FOR SMOOTHING UNFINISHED SURFACES

(76) Inventor: Neal A. Spiva, 1362 Mt. Ida, Oroville, CA (US) 95966

( * ) Notice: Subject to any disclaimer, the term of this patent is extended or adjusted under 35 U.S.C. 154(b) by 259 days.

(21) Appl. No.: 10/366,073

(22) Filed: Feb. 13, 2003

Related U.S. Application Data

(60) Provisional application No. 60/381,071, filed on May 17, 2002.

(51) Int. Cl.
*B24B 1/00* (2006.01)

(52) U.S. Cl. ..... 451/56; 451/28; 451/177; 451/344; 451/360

(58) Field of Classification Search ..... 451/28, 451/56, 177, 344, 360
See application file for complete search history.

(56) References Cited

U.S. PATENT DOCUMENTS 3,858,368 A * 1/1975 Cocherell et al. ..... 451/490
4,897,968 A * 2/1990 Hutt ..... 451/505
5,439,410 A * 8/1995 Larsson ..... 451/28
5,681,211 A * 10/1997 Wiand ..... 451/177

* cited by examiner

*Primary Examiner*—Lee D. Wilson
*Assistant Examiner*—Shantese McDonald
(74) *Attorney, Agent, or Firm*—Richard S. Erbe

(57) ABSTRACT

An apparatus and method for smoothing unfinished surfaces is disclosed. A sanding head having a formed abrasive surface is secured to the mandrel of a rotational tool. A user is able to finish and smooth irregular and fanciful shapes cut into wood or plastic products using power from the tool where previously such operations were performed by extensive hand sanding or polishing. In a second embodiment of the invention, the sanding head is configured to conform to the size and shape of standard router heads currently available on the market. It also uses the standard router guide bearings, which allow it to be used to surface the area that a router has previously cut. In another embodiment of the invention, a standard sanding roller can be mounted on the rotating tool in place of the sanding head for appropriate applications. In yet a further embodiment of the invention, a standard paint roller may be mounted on the rotating tool to enable the user to perform polishing operations on unfinished irregular surfaces.

13 Claims, 5 Drawing Sheets

METHOD AND APPARATUS FOR SMOOTHING UNFINISHED SURFACES

RELATED APPLICATIONS

This application claims the benefit of U.S. Provisional Patent Application No. 60/381,071 filed May 17, 2002, incorporated herein by reference.

BACKGROUND OF THE INVENTION

1. Field of the Invention

This invention relates to carpentry tools. More particularly, the invention relates to a method and apparatus for smoothing unfinished wood or plastic surfaces and edges that are of curved other complex shapes.

2. General Background and State of the Art

Many individuals engage in building products from wood or plastic, either professionally or as a hobby. Enhancement of a person's home or office, for example, is possible by utilizing the tools and techniques known or taught through experience or through researching books or trade journals on the subject.

A wide variety of tools are available to the builder to achieve his or her goals in any building project. Tools vary from the small and simple (pliers, hammers, screwdrivers, to name a few) to the large and complex (lathes, for example). Some tools are powered by hand while others may be powered by electricity. Tools can be used to cut and form simple straight lines or level surfaces. Specialty tools, such as routers, also are available to cut more complex shapes, allowing the individual to form creative and fanciful pieces for purposes of function and/or enhancing the appearance of the finished project.

The process of building a finished product of wood or plastic requires a number of steps. It may be required by the particular project to prepare a piece in some fashion before it is cut. After the piece is cut into its desired configuration, other steps remain, which may include smoothing, polishing, assembling and finishing. Smoothing operations are generally achieved by sanding. Currently, all powered sanding tools are only for flat surfaces. Sanding and polishing of more complex surfaces is achieved through time consuming and painstaking manual sanding and polishing. Some smoothing and polishing of complex surfaces may be attempted by using a router, but there is a risk that the router bit could splinter the piece, therefore ruining the product.

There is no sander currently available that will sand the custom curves and shapes that a router makes on the edges of various projects.

There is no sander currently available that will allow free style sanding with the sanding tubes that are currently widely available.

There is no device currently known that is versatile and will allow the smoothing and polishing of a variety of shapes with easily changeable parts.

SUMMARY OF THE INVENTION

Accordingly, it is an object of the invention to provide a multipurpose machine and method that can be used to meet the requirements of virtually any sanding project that involve complex shapes and surfaces.

Another object of the invention is to provide a sanding tool that can be configured into almost any shape to meet the needs of such a project.

A further object of the invention is to allow the easy interchange of parts so that a sanding project can proceed efficiently with little interruption regardless of the variety of complex curves and surfaces encountered.

An additional object of the invention is to enable the use of removable sanding heads that could match the various shapes currently available in standard router heads.

It is yet another object of the present invention to provide a multipurpose machine that could be used in conjunction with standard sanding tubes and paint rollers to allow for freehand sanding and/or polishing over various surfaces and curves.

These and other objectives are achieved by the present invention, which, in a broad aspect, provides a high degree of flexibility and efficiency in allowing the user to sand and polish a wide range of complex surfaces and curves in wood or plastic products.

An apparatus according to one embodiment of the invention utilizes part of an existing rotational variable speed power tool having a driving mandrel extending from the power unit of the tool. The driving head of the mandrel has locking receptacles in the driving head surface that faces away from the power unit. A sanding head having locking flanges at one of its ends is fitted over the mandrel and is fixed to the driving head by inserting the locking flanges of the sanding head into the locking receptacles of the driving head. The sanding head is further secured to the mandrel by means of a threaded fastener that fits into a threaded recess in the end of the mandrel. A shaped abrasive material is adhered to the outside of the sanding head. The abrasive material can be formed into virtually any shape that will conform to the surface or curve that is to be sanded. When it is desired to use the tool to smooth a different shape, the sanding head can be removed and exchanged with another sanding head that is nearly identical in configuration to the first head, except that on the second sanding head the abrasive material is shaped to conform to the next surface that is to be smoothed. It is possible to build a number of interchangeable sanding heads each having an abrasive layer in a unique configuration that will allow for virtually any complex shape or curve to be smoothed by the tool.

Another embodiment of the invention allows the use of a standard sanding tube to be fixed to the driving head of the mandrel by attaching an extension to the threaded recess in the end of the drive shaft of the mandrel so that the combination of mandrel and extension is sized to accommodate the length of a standard sanding tube. The sanding tube can then be fitted over the drive shaft and extension and fixed at the two ends in a manner similar to the way in which the sanding head is fixed to the mandrel. If so desired, a handle may be secured to the end of the extension instead of a threaded fastener. This application allows for free style sanding of the surface that is to be sanded.

The length of the sanding surface can be extended to accommodate more than one sanding tube by the addition of one or more additional extensions, thus extending the sanding surface available to the user. If larger diameter sanding tubes are needed for certain applications, rubber sleeves can be fixed over the drive shaft and the extension(s) prior to fixing the sanding tube(s) to the drive shaft and extension(s).

In another embodiment of the invention, a standard paint roller can be used in much the same way as the sanding tube for free style polishing of surfaces such as surfing boards or skis.

In a further embodiment of the invention, parts of a rotational variable speed tool will be utilized that will enable the use of removable sanding heads that would match the shapes of currently available router heads and also allow the use of standard router bearings.

Further objects and advantages of this invention will become more apparent from the following description of the preferred embodiments, taken in conjunction with the accompanying drawings, which illustrate, by way of example, the principles of the invention.

DETAILED DESCRIPTION OF PREFERRED EMBODIMENTS OF THE INVENTION

In the following description of the present invention, reference is made to the accompanying drawings, which form a part thereof, and in which are shown, by way of illustration, exemplary embodiments illustrating the principles of the present invention and how it may be practiced. It is to be understood that other embodiments may be utilized to practice the present invention and structural and functional changes may be made thereto without departing from the scope of the present invention.

Figure 1:
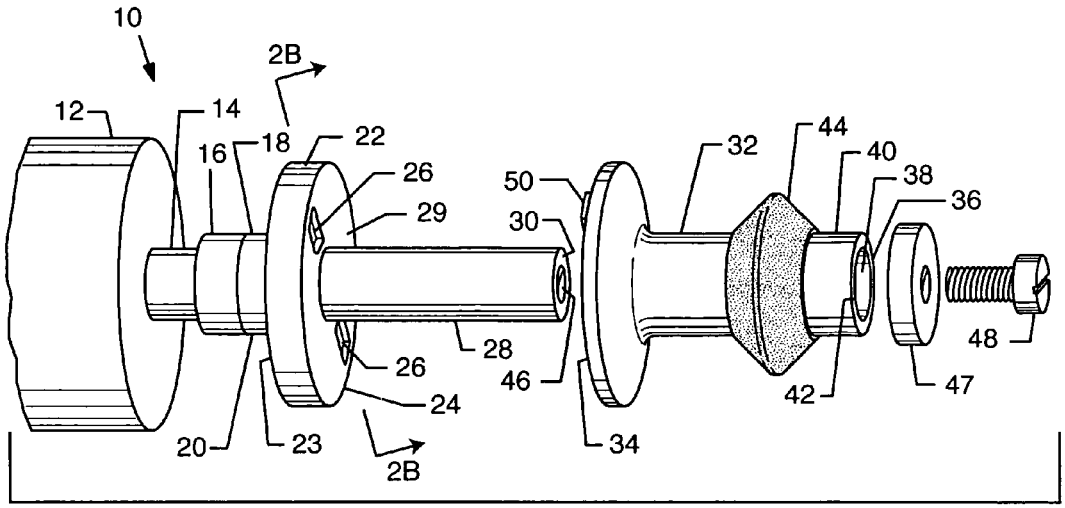
FIG. 1 illustrates an exploded perspective view of an exemplary apparatus according to the present invention.
Figure 2A:
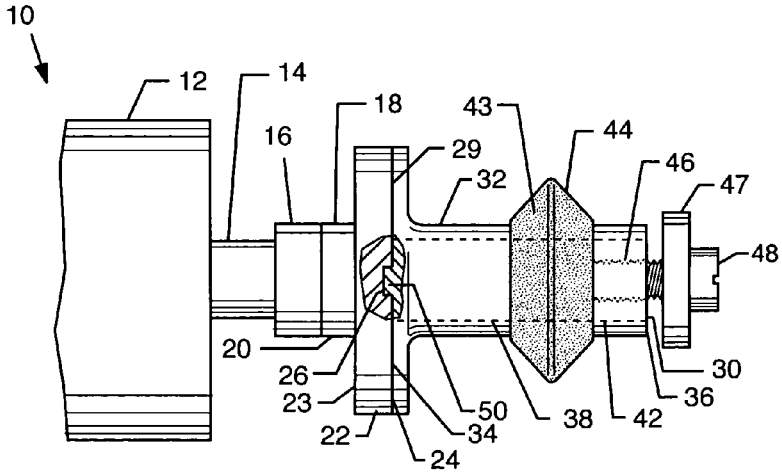
FIG. 2A illustrates a side view of an exemplary apparatus according to the present invention.
Figure 2B:
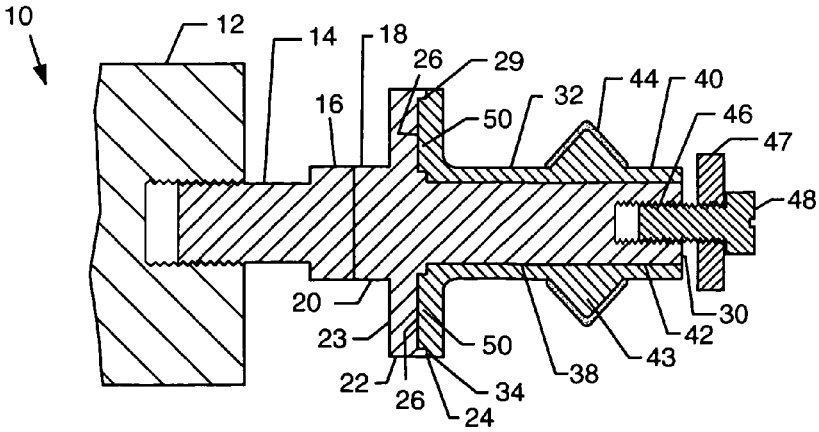
FIG. 2B illustrates a sectional side view an exemplary apparatus according to the present invention

A method and apparatus for smoothing unfinished surfaces, according to the preferred embodiment of the invention, is embodied in a power tool generally referred to by the reference numeral 10 (FIGS. 1, 2A and 2B). A power unit 12 secures arbor 14, collet 16 and mandrel 18, which extend outwardly from power unit 12. While a variety of existing power tools may be suitable for the present application, I have found a Spiral Saw made by the Roto Zip Tool Corporation of Cross Plains, Wis. is well suited for the present application.

Figure 4:
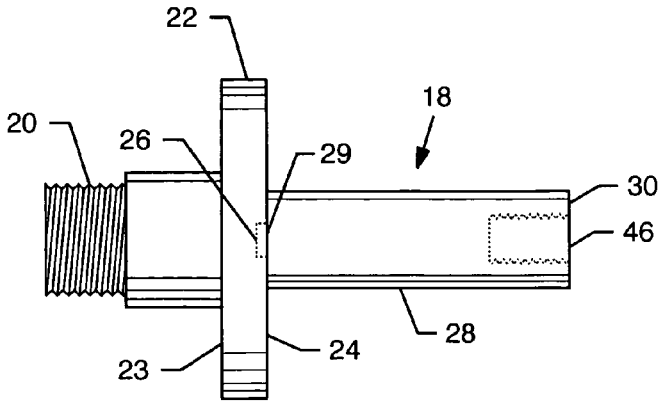
FIG. 4 illustrates a side view of the drive mandrel.

Mandrel 18 is illustrated in greater detail in FIG. 4. Mandrel head 20 includes a threaded portion, which is secured to collet 16. Drive plate 22 of mandrel 18 includes opposing first surface 23 and second surface 24. Embedded in second surface 24 are locking receptacles 26 for securing sanding heads to second surface 24. Although a variety of configurations of locking receptacles 26 may be utilized, in the preferred embodiment of the invention, a pair of horizontal grooves extending radially from the center of second surface 24 have been found to be suitable for use in the present application. Those skilled in the art will appreciate that other configurations of locking receptacles in shape, orientation and number may achieve the identical function as the configuration I have chosen. Mandrel 18 also includes drive shaft 28 extending away from second surface 24 of drive plate 22. Drive shaft 28 further includes threaded recess 46 in end wall 30.

Figure 3A:
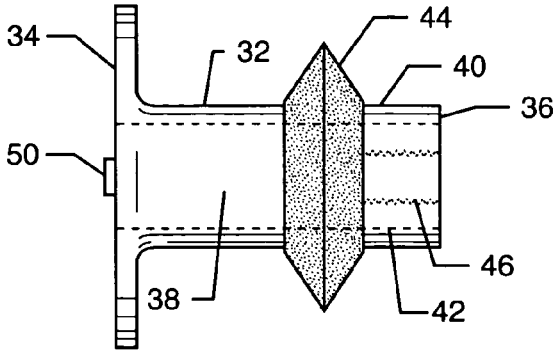
FIG. 3A illustrates a side view of the sanding head with an abrasive formed into a shape having a sharp edge adhered to the outside surface of the sanding head.
Figure 3B:
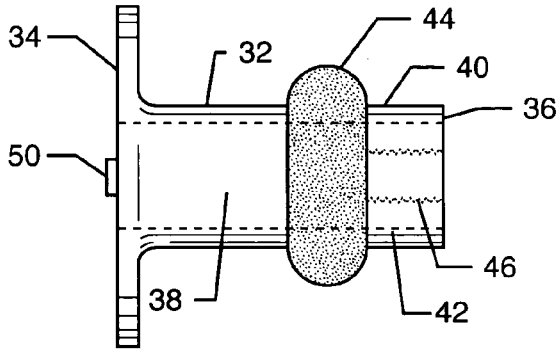
FIG. 3B illustrates a side view of the sanding head with an abrasive formed into a shape having a rounded edge adhered to the outside surface of the sanding head.
Figure 3C:
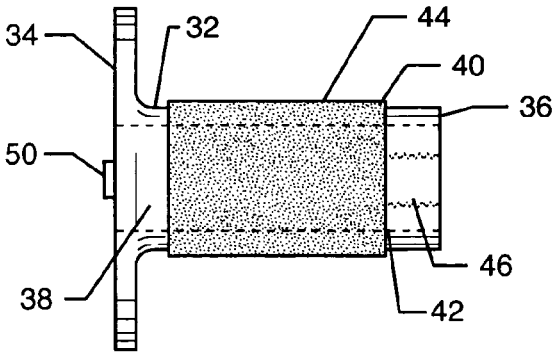
FIG. 3C illustrates a side view of the sanding head with an abrasive formed into a uniform layer adhered to the outside surface of the sanding head.

To utilize tool 10 in accordance with the present invention, a sanding head 32 is mounted on drive shaft 28 of mandrel 18. Various configurations of sanding head 32 are further illustrated in FIGS. 3A, 3B, 3C and 3D. Sanding head 32 may be constructed of various materials including pressed cardboard, hardboard, plastic, or metal, among others. Sanding head 32 is at least partially covered with an abrasive material 44, which is adhered to outer surface 40 and in some cases, to raised surface 43 of outer surface 40 (best illustrated in FIG. 2B). Abrasive material 44 may be one of a variety of know abrasives such as grit, surface flutes, diamond, or carbide. Abrasive material 44 may be formed into a wide variety of shapes that can be made to match virtually any surface that is encountered in a sanding project. FIG. 3C illustrates a sanding head 32 where the abrasive material 44 is shaped into a substantially uniform layer along and around outer surface 40. FIG. 3A illustrates a sanding head 32 where the abrasive material 44 is formed into a shape converging into a sharp-edged face along and around raised surface 43. FIG. 3B illustrates a sanding head 32 where the abrasive material 44 is formed into a shape converging into a substantially rounded face along and around raised surface 43. While FIGS. 3A, 3B, and 3C are illustrative of some specific shapes, it will be appreciated by one of ordinary skill in the art that there are a virtually infinite number of shapes into which abrasive material 44 may be formed, depending upon the surfaces that are to be smoothed.

Figure 3D:
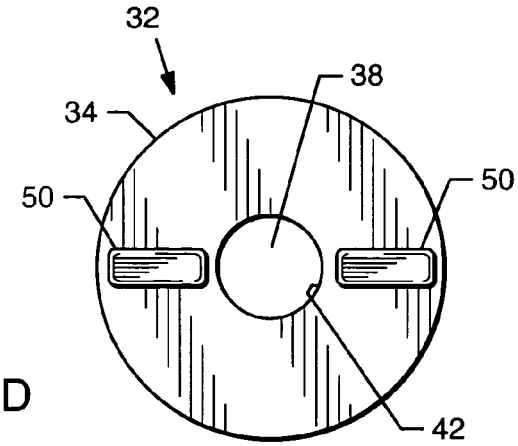
FIG. 3D illustrates an end view of the sanding head.

Sanding head 32 further includes drive locks 50 mounted on first end 34 (FIG. 3D). In the preferred embodiment of the invention, drive locks 50 are in the shape of raised flanges that conform to and fit into locking receptacles 26. It will be appreciated that drive locks 50 can take on any number of configurations depending upon the configuration of locking receptacles 26. Sanding head 32 also includes through hole 38 extending axially through the body of the sanding head. Through hole 38 is sized so that sanding head 32 fits drive shaft 28 and drive locks 50 can be fitted into locking receptacles 26. Sanding head 32 is further secured to mandrel 18 by means of washer 47 and threaded fastener 48 that fastens to threaded recess 46 in second end 36 of drive shaft 28.

In practice the assembled tool 10 is used by applying the abrasive material 44 on sanding head 32 to the curve or shape that requires smoothing. Sanding heads having different shapes formed by raised surface 43 and abrasive material 44 can be easily interchanged as needed as the requirements of any sanding projects dictate by removing threaded fastener 48 from threaded recess 46, releasing drive locks 50 from locking receptacles 26, and sliding the sanding head 32 from the tool 10 and replacing it with a similar sanding head having the appropriately-shaped abrasive material 44 on its outer surface 40. While the present invention allows the flexibility of using one tool for smoothing a wide variety of surfaces, an additional advantage of the present invention is that power unit 12 is a variable speed unit, thus allowing very precise control of the smoothing operation.

Figure 5:
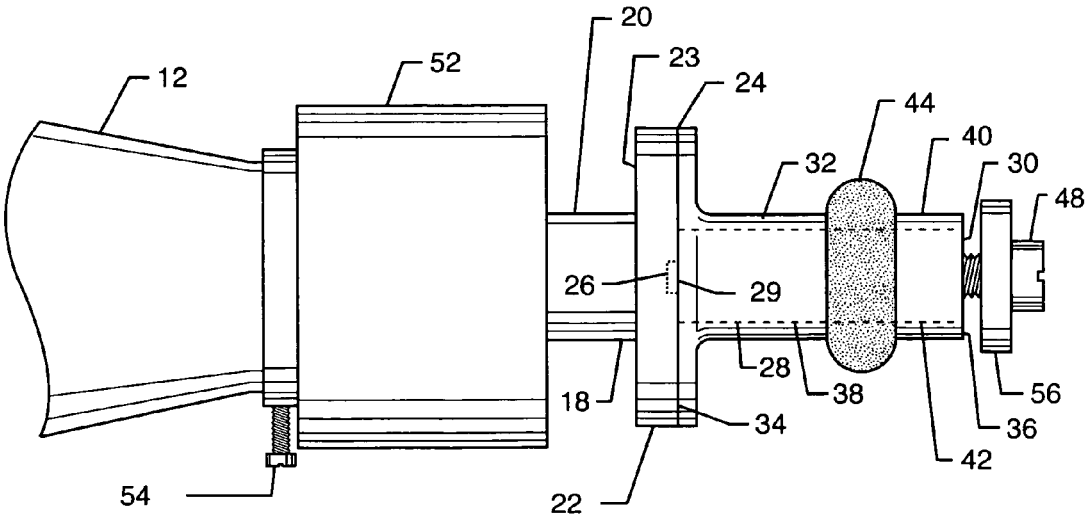
FIG. 5 illustrates a side view of a second embodiment according to the present invention.

FIG. 5 illustrates a second embodiment of the present invention. While similar in many respects to the preferred embodiment of the invention described above, I have adapted a different product for use so that the sanding heads can be made to match the size and shape of the standard ¼-inch router heads currently available on the market. It also uses the standard router guide bearing 56 that would allow it to be used to surface the area that a router has previously cut. In addition, it could be used to round the corners of a small box or soft wood that a normal router head would splinter. Guide bearing 56 is mounted to the unit at second end wall 30 of mandrel 18 and secured to the unit by fastener 48. The sanding heads can be formed into shapes that match the compound curves of some of the router heads, which would then allow the cleaning of an area that a router might have missed or that have become uneven. Abrasive material 44 on sanding head 32 shown in FIG. 5 would be formed in the multiple shapes desired to match the router heads.

In addition, the use of vertical depth guide 52 would allow the depth of the sanding head 32 to be controlled in order to further match the curve and depth to match the routed surface. Guide 52 slips over the power unit 12 and set screw 54 adjusts guide 52 to the desired depth. Guide 52 can be positioned so that it almost reaches abrasive material 44. For this embodiment of the invention, I have found that the Multipro, a product made by Dremel of Racine, Wis., provides a suitable base on which to build the finished unit.

Figure 6A:
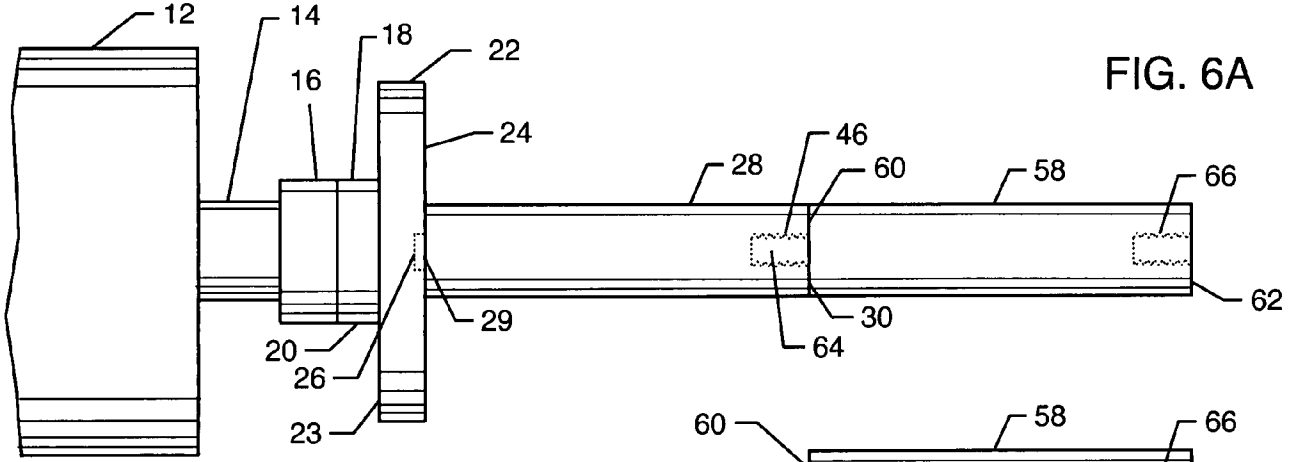
FIG. 6A illustrates a side view of the apparatus without a sanding head in place and with an extension attached to the end of the mandrel.
Figure 6B:
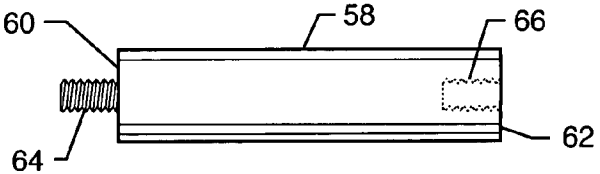
FIG. 6B illustrates a side view of the extension.

Further embodiments of the invention are made possible by extending mandrel 18 to accommodate smoothing fixtures other than sanding heads. In FIG. 6A, sanding head 32 has been removed and extension 58 has been secured to drive shaft 28 by inserting threaded projection 64 on first edge 60 of extension 58 into threaded recess 46. Extension 58, as illustrated in FIG. 6B, includes a threaded receiving port 66 in second edge 62 into which may be mounted an additional extension if so desired. It will be appreciated by those skilled in the art that use of one or more extensions can provide the unit with a variety of lengths that would be suited to the desired application.

Figure 7:
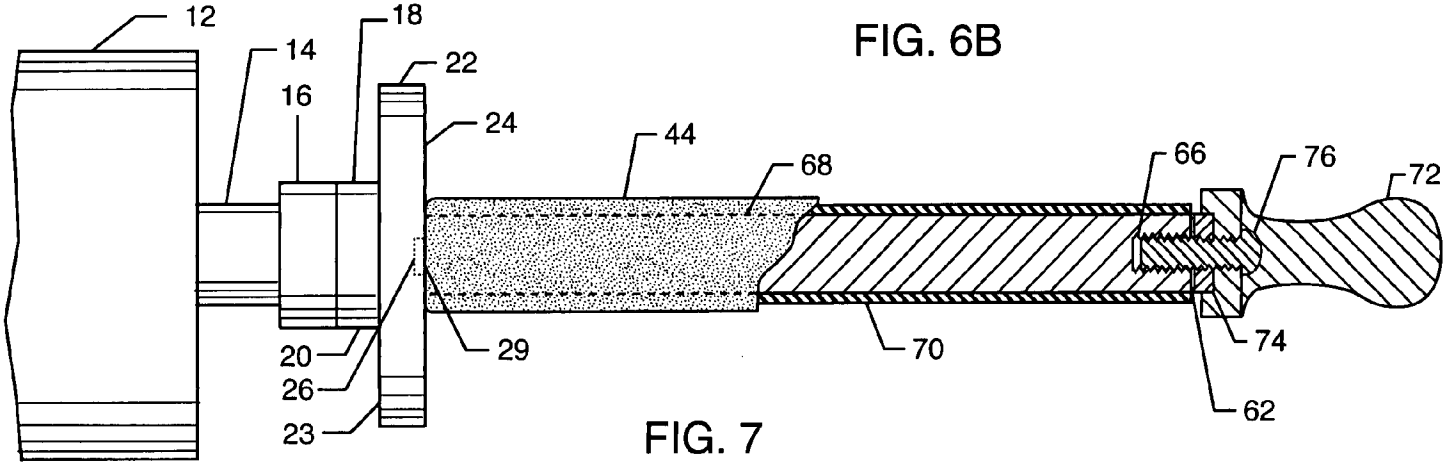
FIG. 7 illustrates a cross-sectional side view of a third embodiment according to the present invention, using a sanding tube in place of a sanding head.

A third embodiment of the present invention is illustrated in FIG. 7, which enables the use of standard sanding tubes currently available on the market. In this embodiment, the extension 58 is sized so that the overall length of drive shaft 28 and extension 58 total a length of 4½ inches and a diameter of ½-inch, which is the length and diameter required to accommodate a standard sanding tube. FIG. 7 shows sanding tube 58 in place. Sanding tube 68 may be secured to drive shaft 28 and extension 68 by using an appropriately sized washer (not shown) and inserting a threaded connector (not shown) into receiving port 66.

If a user so desires, hollow handle 72 may be secured to extension 58 by threading handle fastener 76 into threaded receiving port 66. Thrust bearing 74 is embedded in handle 72 to allow the handle to turn freely during operation.

Two sanding tubes 68 may be used in this application by attaching additional extensions as needed to make the overall length of the drive shaft 9 inches. By using two sanding tubes 68 in tandem, the present invention allows sanding over a 9-inch surface or into complex curves of carvings.

If a user desires to use larger size standard sanding tubes (they are available in sizes up to 1½ inches in *diameter*), a rubber sleeve 70 is placed onto the drive shaft 28/*extension* 58 combination prior to placing the sanding tube 68 on the *apparatus*. R*ubber* sleeves of 4½ inch length are available from the Ridge Tool Company of Elyria, Ohio.

Figure 8A:
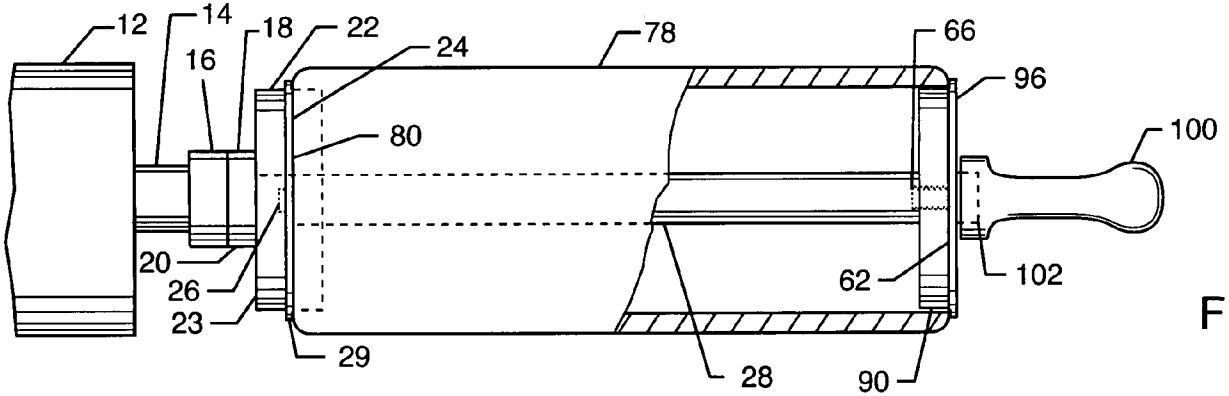
FIG. 8A illustrates a side view of a fourth embodiment according to the present invention, using a paint roller in place of a sanding head.
Figure 8B:
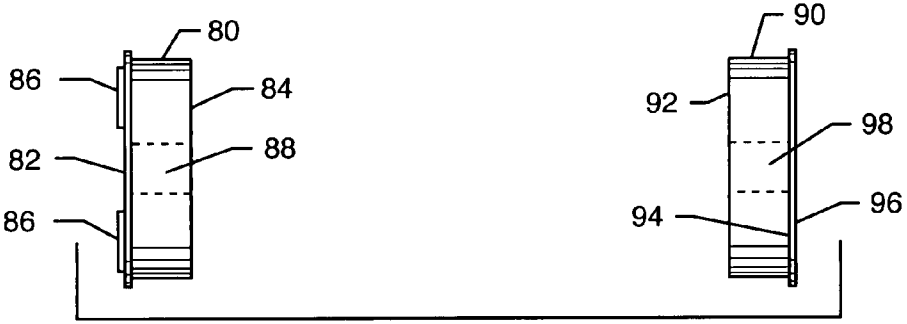
FIG. 8B illustrates a side view of the end caps used in conjunction with the fourth embodiment according to the present invention.

A fourth embodiment of the present invention is illustrated in FIG. 8A, which utilizes a paint roller 78 mounted to drive shaft 28. This embodiment of the invention is ideal for polishing surfaces such as skis, snowboards, and hand rails, among other applications. In order to secure paint roller 78 to drive shaft 28, plastic end caps 80 and 90 are inserted in opposing ends of the paint roller. FIG. 8B illustrates the configuration of the two end caps. Flanged end cap 80 is constructed with locking flanges 86 on first side 82 to secure paint roller 78 to locking receptacles 26 in drive plate 22. Opening 88 in flanged end cap 80 allows paint roller 78 to slide over drive shaft 28. Outer cap 90 is inserted in the opposite end of paint roller 78. Outer cap 90 includes orifice 98, which is sized to slide over drive shaft 28. Roller handle 100 is secured to drive shaft 28 by inserting roller handle screw 102 into threaded receiving port 66. Use of the roller handle 100 in conjunction with paint roller 78 allows the user to better control the polishing task.

Figure 8C:
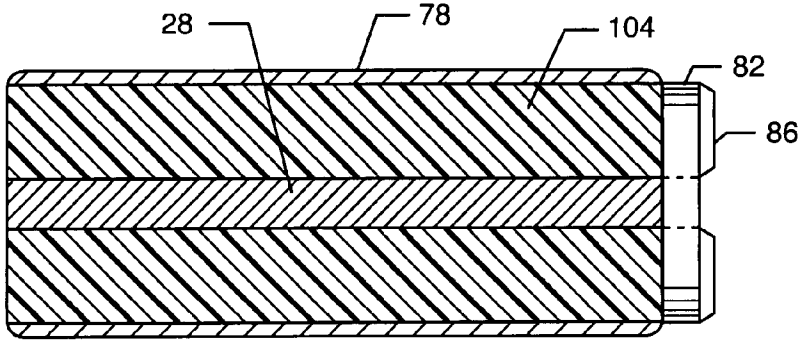
FIG. 8C illustrates a cross-sectional side view of the paint roller and paint roller sleeve used in conjunction with the fourth embodiment according to the present invention.

An alternative way of mounting paint roller 78 to drive shaft 28 in order to ensure a suitable fit between paint roller 78 and drive shaft 28, is through the use of plastic insert 104, which is fitted onto drive shaft 28 after flanged end cap 80 is secured to drive plate 22 as illustrated in FIG. 8C. Paint roller 78 is then mounted on insert 104. The assembled parts are further secured by inserting roller handle screw 102 into threaded receiving port 66.

The foregoing descriptions of exemplary embodiments of the present invention have been presented for purposes of enablement, illustration, and description. They are not intended to be exhaustive of or to limit the present invention to the precise forms discussed. There are, however, other configurations for apparatuses and methods for smoothing unfinished surfaces not specifically described herein, but with which the present invention is applicable. The present invention should therefore not be seen as limited to the particular embodiments described herein, rather, it should be understood that the present invention has wide applicability with respect to sanding and polishing projects. Such other configurations can be achieved by those skilled in the art in view of the descriptions herein. Accordingly, the scope of the invention is defined by the following claims.

What is claimed is:

1. A device for smoothing unfinished surfaces adapted for use with a rotating power tool having a drive mandrel extending from the tool, said mandrel having a drive plate with at least two locking receptacles on one surface of said drive plate, a drive shaft having a threaded recess at one end and a threaded fastener attached to said threaded opening, the device comprising:

a sanding head having opposed first and second ends, a through hole extending axially through said sanding head, forming inner and outer surfaces, said inner surface sized to allow said sanding head to be mounted on the drive shaft;

at least two raised drive locks on said first end to secure said sanding head to the locking receptacles; and a shaped abrasive material adhered to and at least partially covering said outer surface.

2. The device according to claim 1 wherein said abrasive material is configured to conform to the shape of the unfinished surface being smoothed.

3. The device according to claim 1 further comprising a guide bearing secured to the drive shaft by said threaded fastener.

4. The device according the claim 1 wherein said sanding head is configured to match the size of a standard router head.

5. A device for smoothing unfinished surfaces comprising:

a variable speed power unit having an arbor and a collet extending from the power unit;

a mandrel connected to said collet, the mandrel having a drive plate with at least two locking receptacles on one surface of said drive plate and a drive shaft having a threaded recess at one end;

a sanding head having opposed first and second ends and a through hole extending axially through said sanding head for mounting the sanding head on the drive shaft and forming inner and outer surfaces;

at least two locking interfaces on said first end for securing the sanding head to the drive plate;

a shaped abrasive material adhered to and at least partially covering said outer surface; and a threaded fastener attached to said threaded recess.

6. The device according to claim 5 wherein said abrasive material is configured to conform to the shape of the unfinished surface being smoothed.

7. The device according to claim 5 further comprising a guide bearing secured to the drive shaft by said threaded fastener.

8. The device according to claim 5 wherein said sanding head is configured to match the size of a standard router head.

9. A device for smoothing unfinished surfaces comprising:

a variable speed power unit having an arbor and a collet extending from the power unit;

a mandrel connected to said collet, said mandrel having a drive plate with a drive shaft having a threaded recess at one end;

a cylindrical smoothing roller mounted on said drive shaft;

a threaded fastener secured to said threaded recess; and a handle attached to the drive shaft by said threaded fastener.

10. The device according to claim 9 wherein said cylindrical smoothing roller comprises a paint roller.

11. The device according to claim 10 further comprising a sleeve mounted between said drive shaft and said paint roller.

12. The device according to claim 10 further comprising plastic inserts mounted between said drive shaft and said paint roller.

13. A method for smoothing complex shapes cut into wood or plastic, the method comprising:

providing a rotational tool having a drive shaft and a drive head containing locking receptacles on one face of said drive head;

attaching a sanding unit to the drive head with locking flanges on one end of the sanding head;

forming an abrasive material into a configuration conforming to a desired complex shape;

adhering the abrasive material to the sanding unit;

applying the abrasive material to the complex shape; and attaching a guide bearing to the drive shaft.

* * * * *